United States Patent [19]

Berger et al.

[11] Patent Number: 4,483,640

[45] Date of Patent: Nov. 20, 1984

[54] EROSION CONTROL DEVICE

[76] Inventors: Robert C. Berger, Rte. 1, Box 311-13, Stafford, Va. 22554; James W. Smack, Rte. 1, Box 346-S, Leesburg, Va. 22075

[21] Appl. No.: 300,563

[22] Filed: Sep. 9, 1981

[51] Int. Cl.[3] ..... E02B 3/04

[52] U.S. Cl. ..... 405/15; 405/30; 405/32; 210/170

[58] Field of Search ..... 405/15, 16, 21, 22, 405/23, 24, 25, 30, 31, 32, 33, 34, 35, 43, 45; 210/170, 747

[56] References Cited

U.S. PATENT DOCUMENTS

| | | | |
|---|---|---|---|
| 164,510 | 6/1875 | Ball | 210/170 |
| 1,849,323 | 3/1932 | Cleveland et al. | 405/32 |
| 3,003,643 | 10/1961 | Thomas | 405/45 X |
| 3,431,734 | 3/1969 | Vattuone | 405/33 |
| 3,670,504 | 6/1972 | Hayes et al. | 405/32 |
| 4,117,686 | 10/1978 | Hilfiker | 405/30 X |
| 4,175,888 | 11/1979 | Ijima | 405/33 X |
| 4,279,535 | 7/1981 | Gagliardi et al. | 405/32 X |
| 4,330,222 | 5/1982 | Klein | 405/43 X |

FOREIGN PATENT DOCUMENTS

| | | | |
|---|---|---|---|
| 215502 | 1/1958 | Australia | 210/170 |
| 777348 | 2/1935 | France | 405/30 |

*Primary Examiner*—James A. Leppink
*Assistant Examiner*—Beverly E. Hjorth
*Attorney, Agent, or Firm*—Birch, Stewart, Kolasch & Birch

[57] ABSTRACT

A portable erosion control device for filtering run-off water. Two substantially vertically disposed side members are arranged substantially orthogonally with respect to two vertically disposed end members. The side members and end members form a box-like framework. The side members include a plurality of openings large enough to permit a flow of water therethrough. Said side members are substantially impervious to the flow of water therethrough. Partition members extend between the end walls of the box-like framework and are spaced with respect to each other to form a plurality of compartments within the box-like framework. Gripping members are positioned on the end members for facilitating the lifting and subsequent positioning of the box-like framework relative to ground level. Filtering material is positioned between the partition members and the side members. The box-like framework includes an open bottom and open top. The open top permits filtering material to be positioned in the plurality of compartments. The open bottom permits filtering material to be dispensed from the box-like framework when it is elevated above ground level.

2 Claims, 2 Drawing Figures

EROSION CONTROL DEVICE

BACKGROUND

Most types of construction require earthwork that leaves soil exposed to the elements. Federal, state and local governments have required various types of systems and methods to try to contain the soil on the site and keep it from leaving with the runoff water. For the most part these systems and methods have not been very effective. This has caused all our waterways near urban areas to take on a muddy appearance which in turn has resulted in large losses in revenue to water-oriented businesses. Silt and mud washed into our streams have caused severe destruction of plant and aquatic life. In some cases the destruction has been so severe that it has become irreversible.

The object of the present invention is to provide a device and a system for improving erosion problems.

THE DRAWINGS

The drawings show one embodiment of the present invention wherein.

DETAILED DESCRIPTION OF THE PRESENT INVENTION

Figure 1:
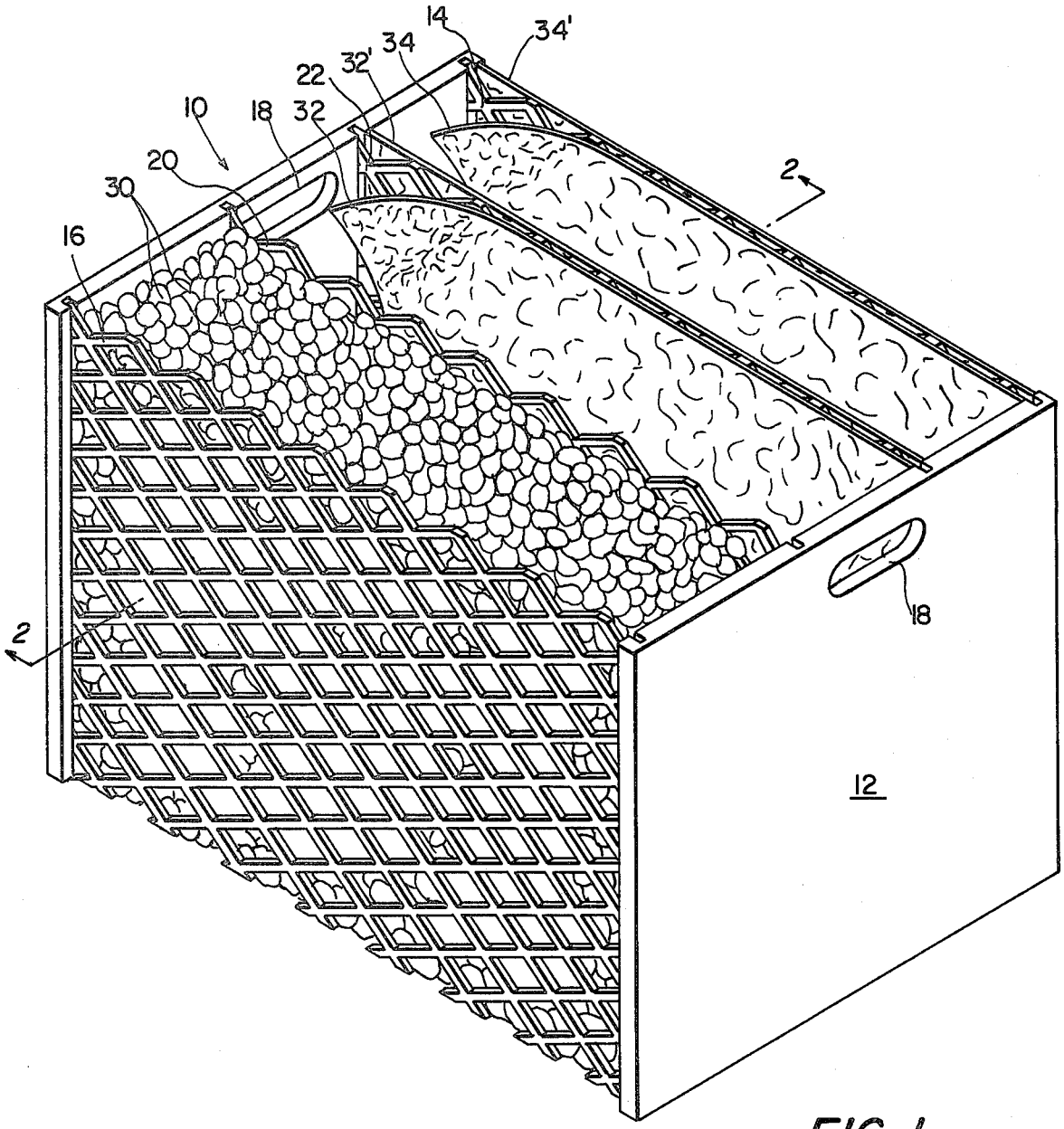
FIG. 1 is a perspective view of our erosion control device.
Figure 2:
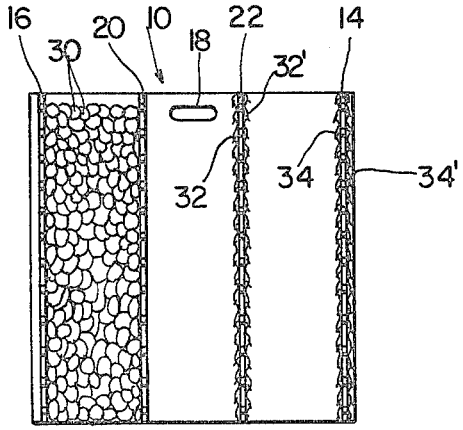
FIG. 2 is a view along 2—2 of FIG. 1.

Referring now to FIG. 1, an erosion control device is shown that consists of two vertically disposed end members 10 and 12 and two vertically disposed side members 14 and 16 that interconnect said end members in a spaced apart relationship. The vertically disposed side members 14 and 16 contain a plurality of openings which are large enough to permit the flow of water therethrough. For instance, the sides 14 and 16 can be slotted, perforated or porous. The end members 10 and 12 are preferably not perforated so that the unit will have greater strength. The end members 10 and 12 are preferably provided with some engaging or gripping means 18 to facilitate lifting or movement of the erosion control device from one location to another. The engaging means can be in the form of a handle, indentation, knob, hole, hook, etc. The sides and ends can be made of metal, plastic or fiberglass.

The sides 14 and 16 can be joined to the ends 10, 12 by welding, bolts, hinges, or any other method. Any desired means may be employed to attain the desired rigidity in the box-like framework composed of members 10, 12, 14 and 16. The length, width, heighth and depth dimensions may be varied widely depending upon the location for the soil erosion device. However, since it is often most convenient to have workmen position the soil erosion devices at a site, the framework should preferably not be heavier than two men can carry.

At least two partition members 20, 22 extend between the end members 10, 12. These partition members are spaced from each other and from the side members 14, 16 so as to thereby form three separate compartments. The partition members 20, 22 have a plurality of openings therein so that water can readily flow therethrough and are preferably formed of expanded metal, heavy screen, or the like. The partition members may be fixed in place in the end walls 10, 12 by welding or bolting, but preferably the partition members are arranged so that they can simply slide up and down in vertical slots (e.g. a tongue and groove joint) in the end walls 10, 12.

The separate compartments preferably have different filtering characteristics so the first chamber that run-off water encounters will filter out some of the particulate materials, the next compartment will filter out some additional materials and the third compartment will filter out still additional material from the run-off water. By way of example, the first compartment could contain loose granular material 30 such as stones, crushed rock, sand or the like, which have a large capacity for removing soil particles without becoming clogged. The second and third compartments could be empty but have filter fabrics or sheets (32 and 34) fastened over the open network of the partition member 22 and the side member 14. In fact both sides of members 22 and 14 could be covered with a filter fabric and the two sheets (e.g. 32, 32' or 34, 34') on a given member stapled together. When such filter fabrics become dirty or clogged they can then be easily cleaned or replaced. If the granular material 30 becomes clogged with silt, the entire framework (10, 12, 14 and 16)can be lifted upwardly from the silt-laden stones (which will remain on the ground) and the framework can be put in a new location and provided with a fresh set of stones.

In some instances it is best to have the impure water first flow through the compartment containing the coarse granular material while in other instances the reverse is true.

There are a number of different sheet-type filters that can be used in accordance with this invention, the only requirement being that they permit the passage of water and prohibit the passage of particles above a certain size. Examples of commercial "erosion filter" sheets that have been found satisfactory are "TYPAR" (DuPont), "PETROMAT" (Phillips Petroleum Company) and "MIRAFI" (Celanese).

When a number of erosion devices in accordance with the present invention are arranged in an end-to-end manner across the path of flowing run-off water, they serve as an effective filter barrier. They can also be used around catch basins, culverts, curb inlets or any other location where watercontaining suspended particulate material is a problem. Our soil erosion devices can also be arranged in series where great purity is desired.

Although the illustrated embodiment shows three separate compartments, four or more compartments could be employed if desired. Also, whereas the illustrated embodiment shows the compartments to be of approximately equal volume, the volumes can all be different. Further, although only one of the compartments has been shown as being filled with granular material, the compartments can be filled with different granular materials (e.g. one compartment with crushed stone and another compartment filled with small pebbles, sand, or the like). Filter materials resembling a furnace filter can also be used in one or more of the compartments.

Since in its preferred form the device of this invention has no bottom, it is light enough to move from site to site, and when positioned in a desired position can be partially filled with heavy material such as crushed stone. When the erosion control device has fulfilled its function in a given location the framework can be readily disengaged from any heavy material in the compartments by merely lifting the framework upwardly. The device can then be easily carried to a new location and new heavy material used.

We claim:

1. A portable erosion control device for filtering run-off water comprising:

two substantially vertically disposed side members;

two substantially vertically disposed end members substantially orthogonally disposed with respect to said side members for interconnecting said side members in a spaced apart relationship for forming a box-like framework;

said side members having a plurality of openings large enough to permit a flow of water therethough, said end members being substantially impervious to the flow of water therethrough;

at least two substantially vertically disposed, removably mounted, partition members extending between the end walls of said box-like framework, said partition members being substantially orthogonally disposed with respect to said end members and being substantially parallel to said side members and spaced from said side members and from each other for forming a plurality of compartments with said box-like framework, said partition members having a plurality of openings therein to permit the flow of water therethrough and at least one of said partition members including a filter sheet or cloth extending across its surface;

gripping means being positioned on said end members for facilitating lifting and subsequent positioning of said box-like framework relative to ground level; and filtering material being positioned between said partition members and said side members;

said box-like framework includes an open bottom and open top, said open top being adapted to receive said filtering material within said plurality of compartments for filtering run-off water passing therethrough, said open bottom being adapted to permit filtering material to be dispensed therefrom when said box-like framework is elevated above ground level.

2. A portable erosion control device according to claim 1 wherein one of said compartments is adapted to contain granular material.

* * * * *